US006796630B2

(12) United States Patent
Ison et al.

(10) Patent No.: US 6,796,630 B2
(45) Date of Patent: Sep. 28, 2004

(54) DROPLET DEPOSITION APPARATUS

(75) Inventors: Robert M. Ison, Cambridge (GB); Werner Zapka, Jarfalla (SE); Jerzy M. Zaba, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 10/204,040

(22) PCT Filed: Feb. 16, 2001

(86) PCT No.: PCT/GB01/00652

§ 371 (c)(1),
(2), (4) Date: Dec. 6, 2002

(87) PCT Pub. No.: WO01/60627

PCT Pub. Date: Aug. 23, 2001

(65) Prior Publication Data

US 2003/0128254 A1 Jul. 10, 2003

(30) Foreign Application Priority Data

Feb. 17, 2000 (GB) ..... 0003760

(51) Int. Cl.[7] ..... B41J 29/377; B41J 2/16
(52) U.S. Cl. ..... 347/18; 347/49
(58) Field of Search ..... 347/8, 18, 49

(56) References Cited

U.S. PATENT DOCUMENTS

| | | | | |
|---|---|---|---|---|
| 3,960,255 A | | 6/1976 | Bisson et al. | 197/1 R |
| 4,350,448 A | | 9/1982 | Hanagata et al. | 400/120 |
| 4,570,168 A | | 2/1986 | Sjordal et al. | 347/69 |
| 4,887,100 A | | 12/1989 | Michaelis et al. | 346/140 R |
| 5,402,162 A | | 3/1995 | Fusting et al. | 347/43 |
| 5,622,897 A | | 4/1997 | Hayes | 438/21 |
| 5,696,541 A | * | 12/1997 | Akahane et al. | 347/8 |
| 5,831,655 A | | 11/1998 | Asawa et al. | 347/102 |
| 6,266,117 B1 | | 7/2001 | Yanagawa et al. | 349/141 |
| 6,672,707 B2 | * | 1/2004 | Silverbrook | 347/49 |

FOREIGN PATENT DOCUMENTS

| | | | | |
|---|---|---|---|---|
| EP | 277 703 A1 | | 8/1988 | |
| EP | 278 590 A1 | | 8/1988 | |
| EP | 857 572 A2 | | 8/1998 | |
| EP | 857 572 A3 | | 5/1999 | |
| JP | 59096968 A | * | 6/1984 | B41J/3/04 |
| JP | 03234534 A | * | 10/1991 | B41J/2/01 |
| WO | WO 91/17051 | | 11/1991 | |
| WO | WO 97/10530 | | 3/1997 | |
| WO | WO 97/21555 | | 6/1997 | |
| WO | WO 99/11461 | | 3/1999 | |

OTHER PUBLICATIONS

International Search Report in PCT/GB01/00652 dated Aug. 20, 2001.

International Preliminary Examination Report in PCT/GB01/00652 dated May 29, 2002.

* cited by examiner

*Primary Examiner*—Stephen D. Meier
*Assistant Examiner*—Alfred Dudding
(74) *Attorney, Agent, or Firm*—Marshall, Gerstein & Borun LLP

(57) ABSTRACT

Droplet deposition apparatus includes a base and a printhead adjustably mounted on the base and positionable relative to a datum on the base such that a swath or print produced by the printhead is in a predetermined position relative to the datum, the base being locatable on a printer using the datum. This can enable the printer to be easily replaced without any loss of alignment of the produced print swath relative to the carriage or body of the printer.

26 Claims, 10 Drawing Sheets

FIG. 15
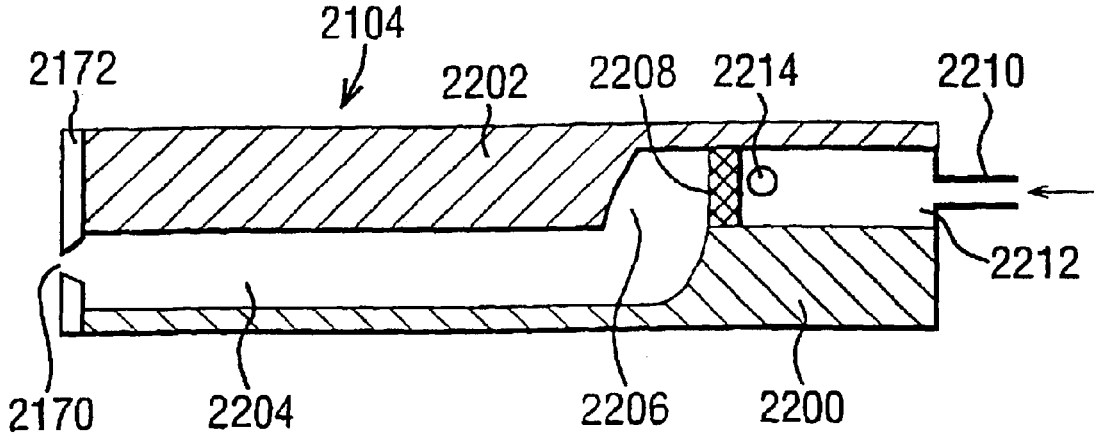
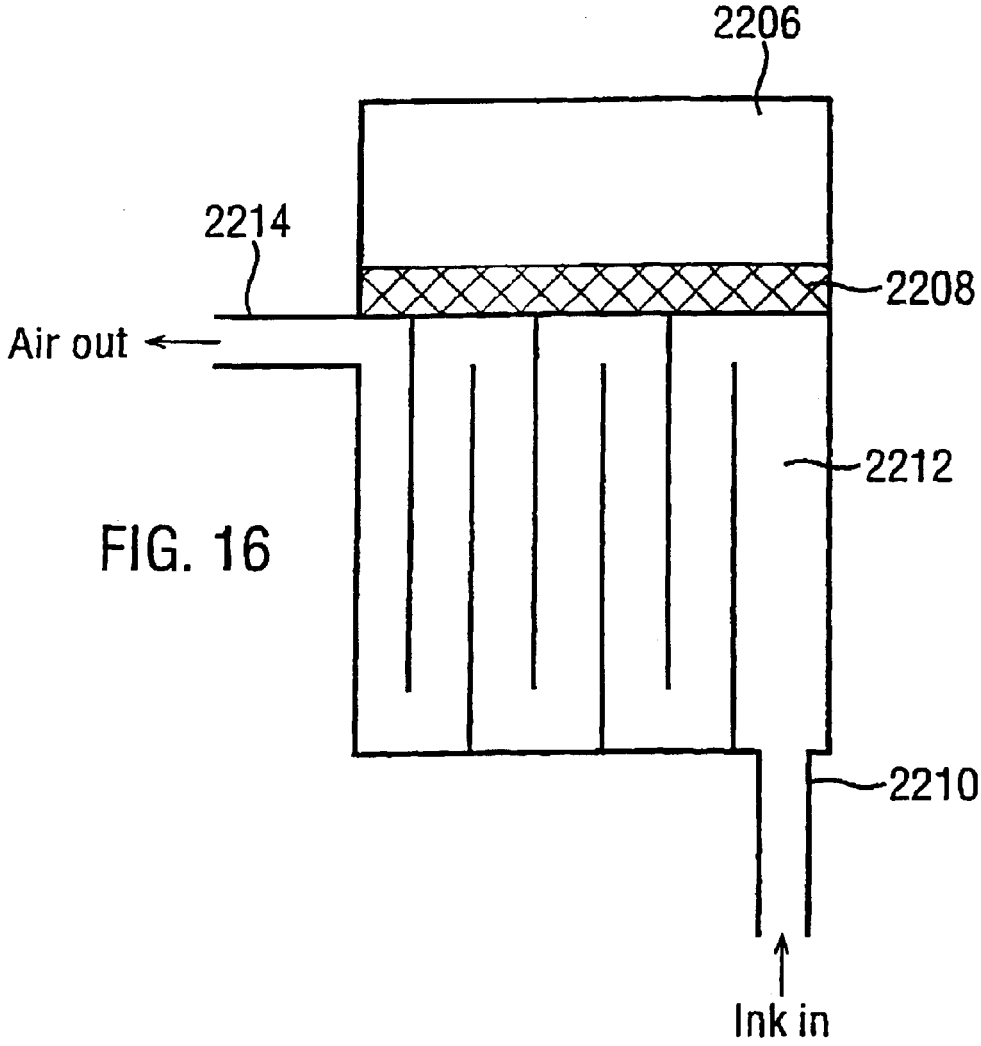
FIG. 16

DROPLET DEPOSITION APPARATUS

This is the U.S. national phase of International Application No. PCT/GB01/00652 filed Feb. 16, 2001, the entire disclosure of which is incorporated herein by reference.

The present invention relates to a droplet deposition apparatus such as, for example, a drop-on-demand inkjet printer.

A typical drop-on-demand ink jet printer includes one or more printheads mounted on the carriage or printer body of a printer, with ink being ejected from one or more ink reservoirs located in the printer through nozzles formed in the or each printhead.

In view of the demand for higher resolution drop-on-demand inkjet printing, it is desirable to control accurately the precise locations at which ink ejected from the nozzles lands on a print surface. Accordingly, each printhead is individually aligned on the carriage or printer body. If one of the printheads were to become defective in any way, it is necessary to remove the defective printhead and re-align accurately the replacement printhead on the carriage or printer body. This can be a difficult, and therefore time-consuming, operation.

In its preferred embodiments, the present invention seeks to solve these and other problems.

In a first aspect, the present invention provides droplet deposition apparatus comprising a base and a printhead adjustably mounted on the base and positionable relative to a datum on the base such that a swath of print produced by the printhead is in a predetermined position relative to the datum, the base being locatable on a printer using the datum.

As the swath of print produced by a printhead is aligned with a datum formed on the base and used to mount the base to the printer, the printhead can be easily replaced without any loss of alignment of the produced print swath relative to the carriage or body of the printer. The alignment of the swath with a single datum formed on the base also improves the ease of alignment of the swath relative to the carriage or printer body; as the print may be ejected at an angle to the axes of the nozzles of the printhead, the position of the printhead is adjusted in relation to the produced print swath.

In a preferred arrangement, the apparatus comprises a plurality of printheads, each printhead being adjustably mounted on the base and positionable relative to the datum on the base such that swathes of print produced by the printheads are in respective predetermined positions relative to the datum.

Thus, the above advantages in respect of a single printhead are also provided with a multi-printhead arrangement, so that, for example, if the printer were to become defective, the base can be removed from the defective printer and accurately mounted on the replacement printer using the datum, that is, without having to re-align each individual printhead, so that the swaths of print to be produced by the printheads are still in the correct alignment.

Furthermore, when using a plurality of printheads in order to increase print width, it is important that the first nozzle of a second printhead is positioned as close as possible to one pitch after the last nozzle of the first printhead in order to maintain a high print quality between the printheads. By means of the present invention, this positioning can be conducted quickly and easily.

The printheads may be arranged in pairs on the base, for example, side-by-side pairs. This can increase the density of the mounting of the printheads on the base, thus providing for a compact droplet deposition apparatus.

In a preferred embodiment, the apparatus comprises means for adjusting the position of the or each printhead on the base relative to the datum. This can enable individual printheads to be positioned on the base so that the swaths of print produced by the printheads are in the predetermined positions relative to the datum.

The adjusting means may comprise means for adjusting the location of the or each printhead relative to the datum and means for adjusting the orientation of the or each printhead relative to the datum. Thus, the location and orientation of the printhead on the base can be individually adjusted.

The adjusting means may comprise a plurality of adjustment members engaging the or each printhead, each adjustment member being movable relative to the base so as to adjust the position of the printhead on the base. For example, each adjustment member may comprise a tapered surface, the printhead being urged against the tapered surface so that movement of a tapered surface relative to the base adjusts the position of the printhead on the base. One suitable adjustment member is a tapered screw having a screw thread engaging a conformingly-profiled threaded bore formed in the base, with axial movement of the screw within the bore causing the printhead, urged against the tapered surface, to move relative to the base. As the motion of the screw within the bore may be accurately controlled, the alignment of the swath of print from the printhead with the datum on the base is thus also accurately controlled.

The printhead may have a conformingly tapered surface engaging the tapered surface of the adjustment member. The engagement of the conformingly tapered surfaces can enable the printhead to be held against the base by the adjustment members.

The apparatus preferably comprises means, resiliently mounted on the base, for urging a printhead against the adjustment means. This can ensure that any adjustment of the adjustment means is transferred substantially completely to the printhead.

The apparatus preferably comprises means, mountable on the base, for shielding the adjustment means in order to prevent accidental adjustment of the position of the or each printhead on the base.

The apparatus may further comprise a slotted member, mountable on the base, having at least one slot formed therein so that fluid ejected from the or each printhead passes through a respective slot.

Each printhead may comprise a plurality of nozzles formed in a nozzle plate, the nozzle plate and the walls of the slot through which ink ejected from the nozzles passes defining at least part of a recess into which ink removal means is movable to remove any ink collected in the recess following ejection from one of the nozzles.

The present invention also provides apparatus for positioning an object relative to a datum, said apparatus comprising a base bearing said datum and comprising means for receiving an object, a plurality of tapered adjustment members each being movable relative to the base, and means for urging a received object against the adjustment members so that movement of an adjustment member relative to the base adjusts the position of a received object relative to said datum.

Preferably, said adjustment members comprise a first adjustment member for adjusting the location of a received object relative to the datum and a second adjustment member for adjusting the orientation of a received object relative to the datum.

Preferably each adjustment member comprises a tapered screw engaging a conformingly tapered bore formed in the base.

Preferably, the urging means is resiliently mounted on the base.

The receiving means may comprise a frame for receiving an object, the position of the frame relative to the datum being adjustable by moving said adjustment members.

The present invention further provides apparatus for positioning a plurality of objects relative to a datum, said apparatus comprising a base bearing said datum and comprising a plurality of receiving means each for receiving a respective object, and, for each receiving means, a plurality of tapered adjustment members each being movable relative to the base and means for urging a received object against the adjustment members so that movement of an adjustment member relative to the base adjusts the position of a received object relative to said datum.

The apparatus is preferably for positioning one or a plurality of printheads such that a swath of print produced by the or each printhead is in a predetermined position relative to the datum, the base being locatable on a printer using the datum.

The present invention yet further provides a method of positioning an object relative to a datum borne by a base comprising means for receiving an object, a plurality of tapered adjustment members each being movable relative to the base, and means for urging a received object against the adjustment members, the method comprising the steps of mounting an object in said receiving means and moving an adjustment member relative to the base to adjust the position of the received object relative to said datum.

The method preferably comprises the steps of moving a first adjustment member to adjust the location of the received object relative to the datum and moving a second adjustment member to adjust the orientation of the received object relative to the datum.

Non-ejection of droplets from droplet ejection apparatus, such as drop-on-demand ink jet printing apparatus, can result from the presence of air bubbles in droplet fluid housed in a fluid chamber communicating with the nozzle. Air bubbles can interfere with the acoustics within a fluid chamber to such a degree so at to prevent droplet ejection from the chamber. Due to the small size of the nozzles, it is difficult to remove air bubbles from the chamber without effectively "flushing out" the entire system.

In its preferred embodiments, the present invention seeks to solve these and other problems.

The present invention provides a printhead comprising:

at least one fluid chamber having actuator means actuable by electrical signals to effect ejection of droplets therefrom; and conduit means for conveying droplet fluid towards and/or away from the or each fluid chamber, and for leading air bubbles in said droplet fluid to an air outlet.

By leading air bubbles in the droplet fluid to an air outlet, such as an air bleed outlet, the presence of air bubbles in the fluid chambers can be avoided.

The printhead may comprise a fluid inlet for supplying fluid to said at least one fluid chamber, and a filter disposed between said at least one fluid chamber and said fluid inlet, said conduit means being arranged to convey droplet fluid from said fluid inlet to said filter. The conduit means may be serpentine.

Thus, the present invention also provides a printhead comprising at least one fluid chamber having actuator means actuable by electrical signals to effect ejection of droplets therefrom, a fluid inlet for supplying fluid to said at least one fluid chamber, a filter disposed between said at least one fluid chamber and said fluid inlet, and serpentine conduit means for conveying droplet fluid from said fluid inlet to said filter. The printhead preferably comprises an air outlet, said serpentine conduit means being arranged to lead air bubbles in fluid conveyed thereby to said air outlet.

The air outlet may be disposed between said serpentine conduit means and said filter. The air outlet may be adapted to convey fluid away from said filter, that is, the air outlet may also be a fluid outlet of the printhead.

The at least one fluid chamber may be formed in a sheet comprising a layer of piezoelectric material, with the conduit means being formed in a cover bonded to said sheet. The filter may be integral with the cover.

The present invention further provides a printhead comprising a sheet comprising a layer of piezoelectric material, at least one fluid chamber being formed in said sheet, a cover bonded to said sheet, and serpentine conduit means formed in said sheet for conveying droplet fluid to said at least one fluid chamber. Preferably, a filter is formed in said sheet so that fluid conveyed from said serpentine conduit means to said at least one fluid chamber passes through said filter.

In a piezoelectric drop-on-demand ink jet printhead, an acoustic pressure wave is generated by an electrical signal to eject a droplet of fluid (e.g. ink) from a fluid chamber. The apparatus may have a single such fluid chamber, but more typically has a printhead with an array of such chambers each with a respective nozzle, the printhead receiving data-carrying actuating electrical signals which provide the power necessary to eject droplets from the chambers on demand. Each chamber is bounded by a piezoelectric element which is caused to deflect by the actuating electrical signal, thereby generating the acoustic pressure wave which ejects the droplet. Reference is made to our published specifications EP 0277703, U.S. Pat. No. 4,887,100 and WO91/17051 for further details of typical constructions.

During printing, heat is generated in a fluid chamber by actuation of the piezoelectric element. Some of this heat is transferred to the ejection fluid in the chamber, which can give rise to a variation in the viscosity of the ejection fluid between the fluid chambers. Such variations in the viscosity of the ejection fluid can give rise to variations in droplet ejection velocity and consequent dot placement errors in the printed image.

In its preferred embodiments, the present invention also seeks to solve this and other problems.

The present invention provides in another aspect a printhead comprising a base, at least one fluid chamber formed in said base, means for ejecting fluid from said at least one fluid chamber, a cover attached to said base, and a heat sink attached to the cover for dissipating heat generated in the printhead during the ejection of fluid from said at least one fluid chamber.

By attaching a heat sink to the cover, heat generated in the printhead during the ejection of fluid from a fluid chamber can be quickly dissipated from the fluid chamber, thereby minimising the duration of any significant variation in the viscosity of fluid in the fluid chamber.

The use of a heat sink can also enable the temperature of fluid in ejecting and non-ejecting fluid chambers to be rapidly equalized by distributing heat generated during fluid ejection amongst the fluid chambers, thereby minimising any variation in the viscosity of the fluid between the chambers. Accordingly, the present invention also provides a printhead comprising a base, a plurality of fluid chambers formed in said base, means for ejecting fluid from said fluid chambers, a cover attached to said base, and a heat sink attached to the cover for distributing amongst said fluid chambers heat generated during the ejection of fluid from said printhead.

To improve heat transfer from the fluid to the heat sink, the cover is preferably formed from material having a higher thermal conductivity than said base. Preferably, the cover is formed from material having substantially the same coefficient of thermal expansion as the base, so as to avoid distortion of the printhead that might otherwise occur as a result of the differing thermal expansion characteristics of the material of the base and the material of the cover. For example, the cover may be formed from silicon or aluminium nitride, and the base may be formed from piezoelectric material.

Preferably, the cover comprises fluid supply means for supplying fluid to said at least one fluid chamber. The heat sink may comprise a fluid inlet for conveying fluid to said fluid supply means. Preferably, the heat sink comprises a plurality of fins disposed side by side in a row.

To enable heat to be rapidly dissipated from the heat sink, the printhead preferably comprises means for supplying a stream of coolant fluid, such as a pressurized air stream, to the printhead.

The printhead preferably comprises a casing for said printhead, said casing comprising an inlet for receiving said stream of coolant fluid and an outlet for said coolant fluid. This can enable the drive circuitry which supplies the actuating electrical signals also to be cooled by the coolant fluid, thus reducing the likelihood of overheating of the drive circuitry.

Preferably, means for adjusting the pressure of the coolant fluid within said casing are provided. Means for adjusting the rate at which said coolant fluid stream enters the casing are also preferably provided. Valves may be provided at the inlet and outlet of the casing to adjust both the air flow and air pressure within the printhead.

In one preferred embodiment, the cover comprises at least one substantially planar sheet.

The invention is further illustrated, by way of example, with reference to the accompanying drawings, in which.

Figure 4A:
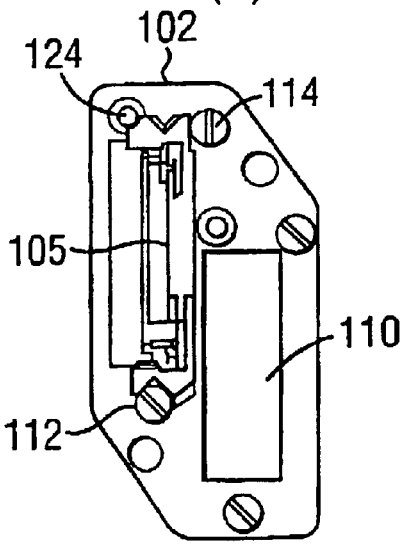
Figure 4B:
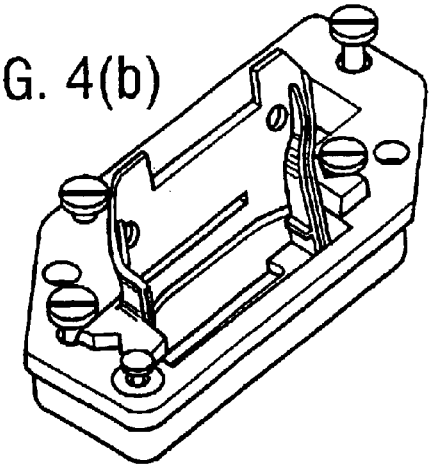
Figure 4C:
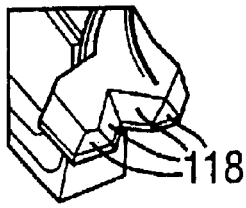
Figure 5A:
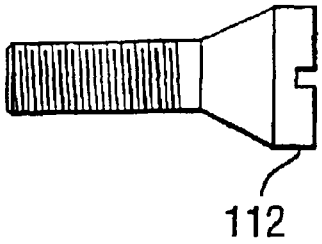
Figure 5B:
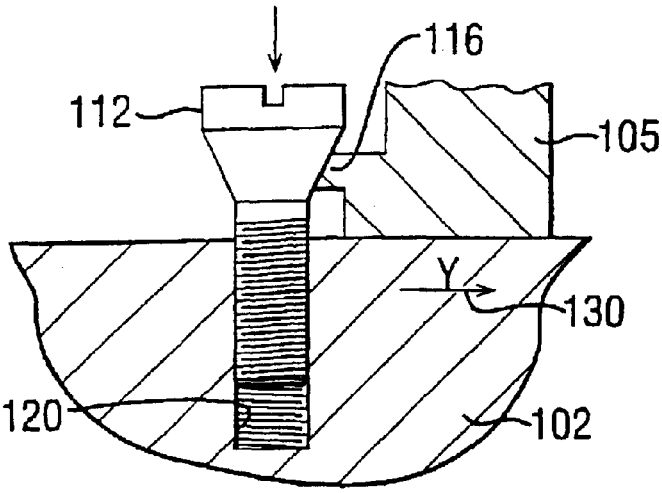
Figure 5C:
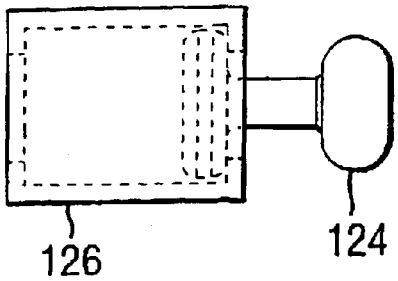

FIGS. 4(*a*) and (*b*) represent a top view and a perspective view respectively of a third embodiment of droplet deposition apparatus illustrating a printhead frame mounted on the base plate, and FIG. 4(*c*) represents a perspective view of the alignment surfaces of a printhead frame;

FIG. 5(*a*) represents a side view of an adjustment screw; FIG. 5(*b*) represents a simplified cross-sectional view of the engagement of a printhead frame with an adjustment screw, and FIG. 5(*c*) represents a side view of a thrust pin.

Figure 6:
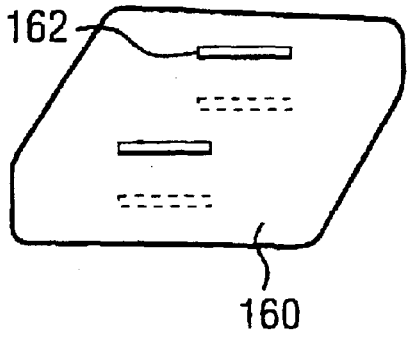
Figure 7:
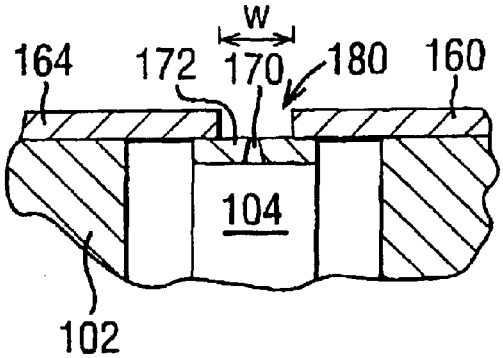
Figure 8:
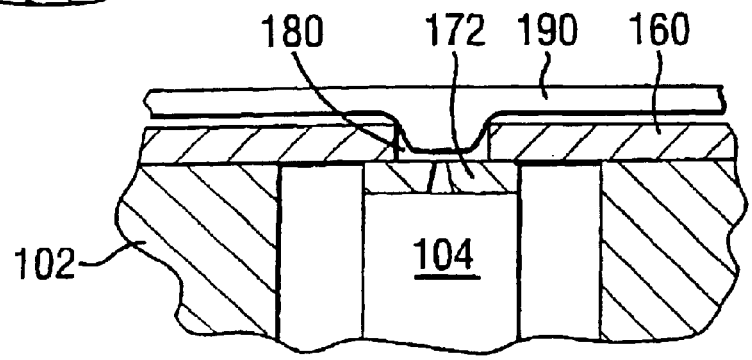

FIG. 6 represents a perspective view of an embodiment of a slotted plate of the base plate of the droplet deposition apparatus;

FIG. 7 represents a cross-sectional view of the printhead illustrating the alignment of a slotted plate with a base plate; and FIG. 8 is the same cross-sectional view of FIG. 7 illustrating the action of a nozzle wiper.

Figure 9:
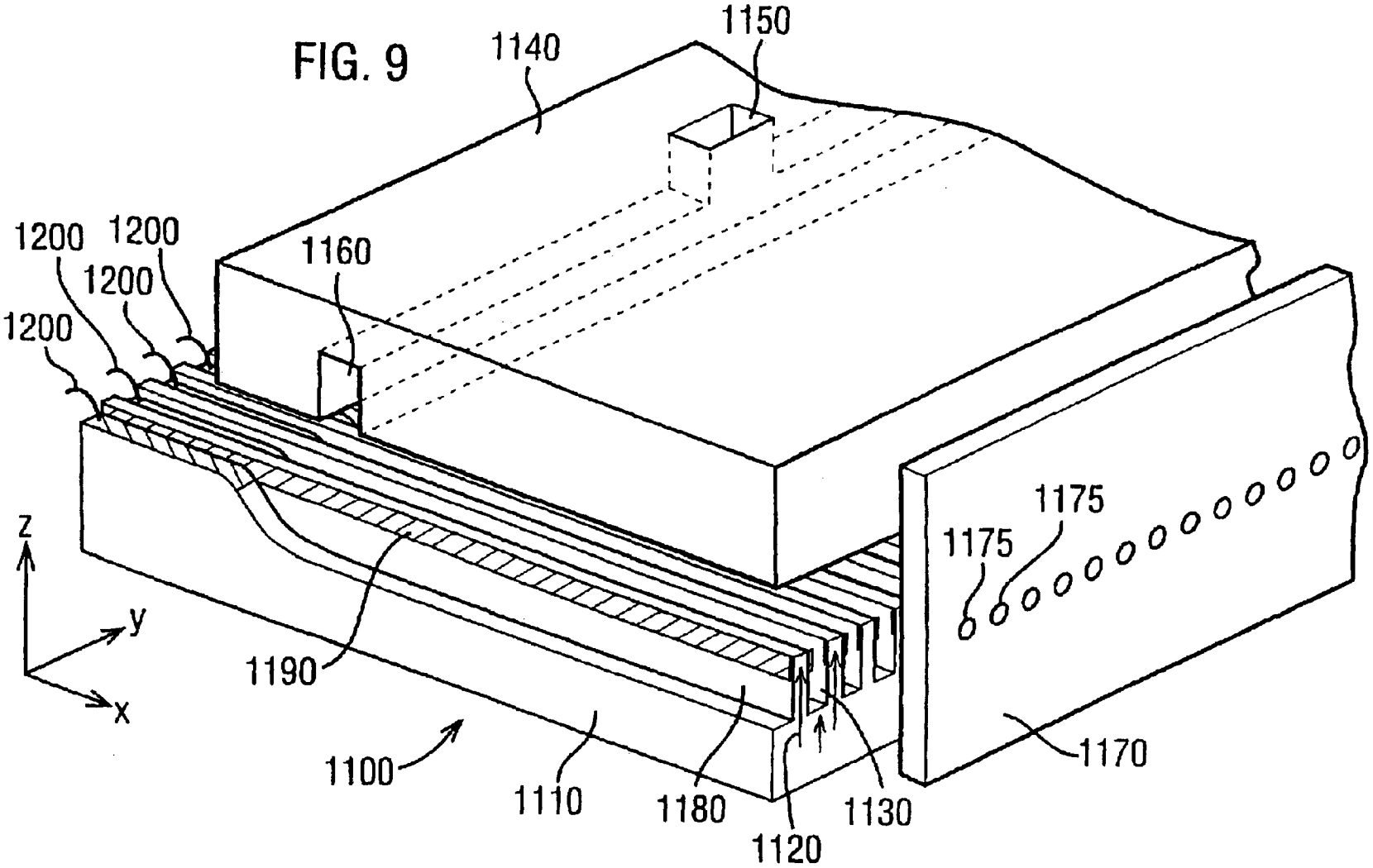
Figure 10:
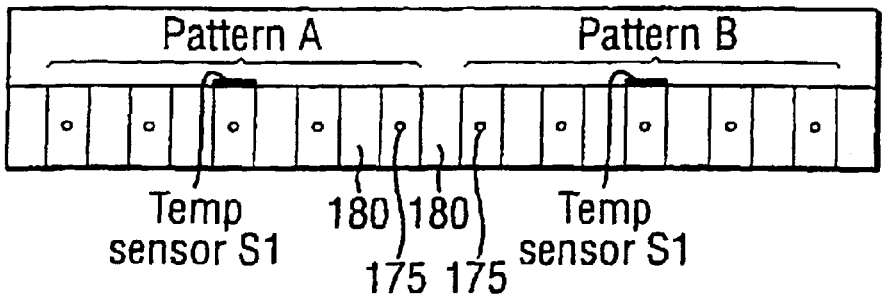
Figure 11:
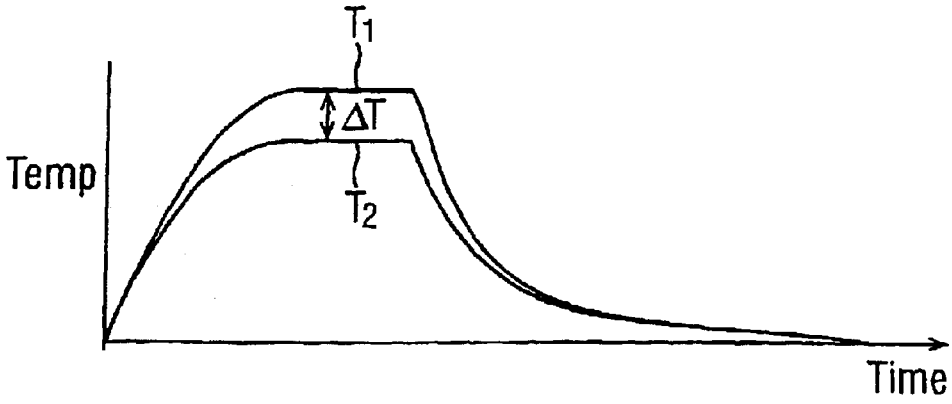
Figure 12:
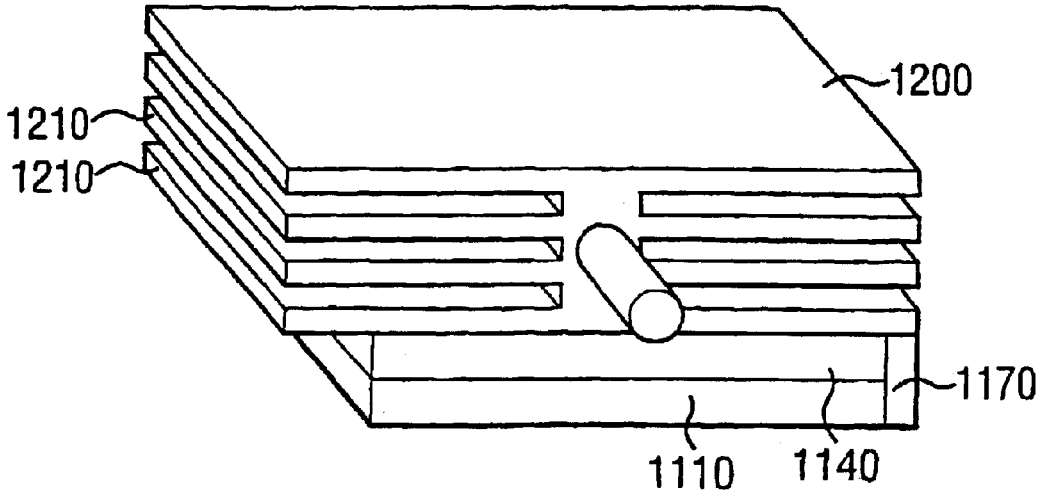
Figure 13:
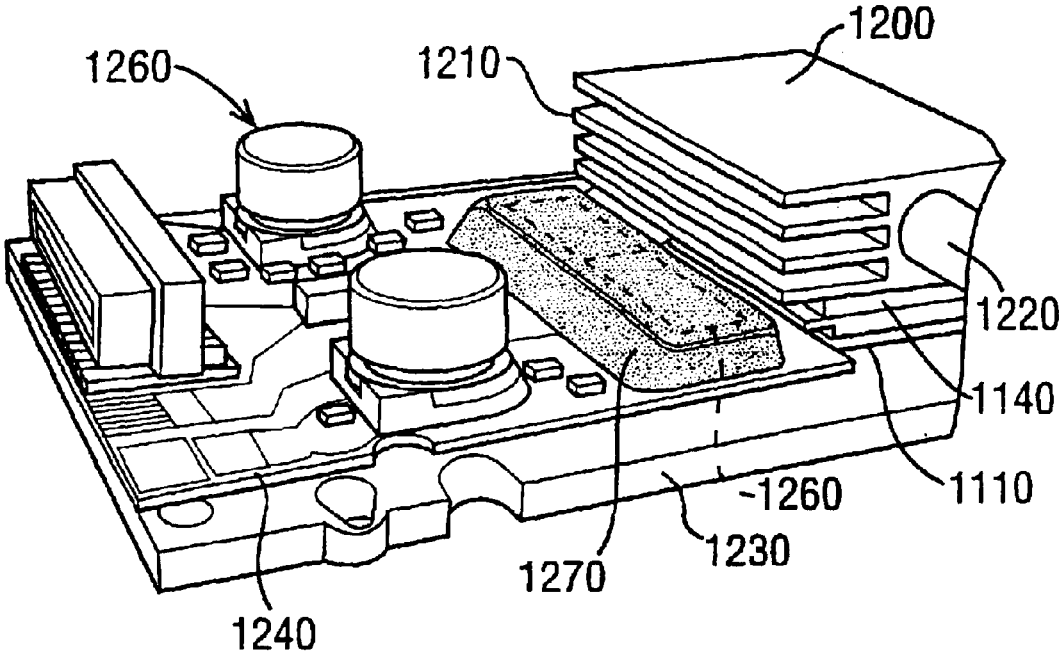
Figure 14:
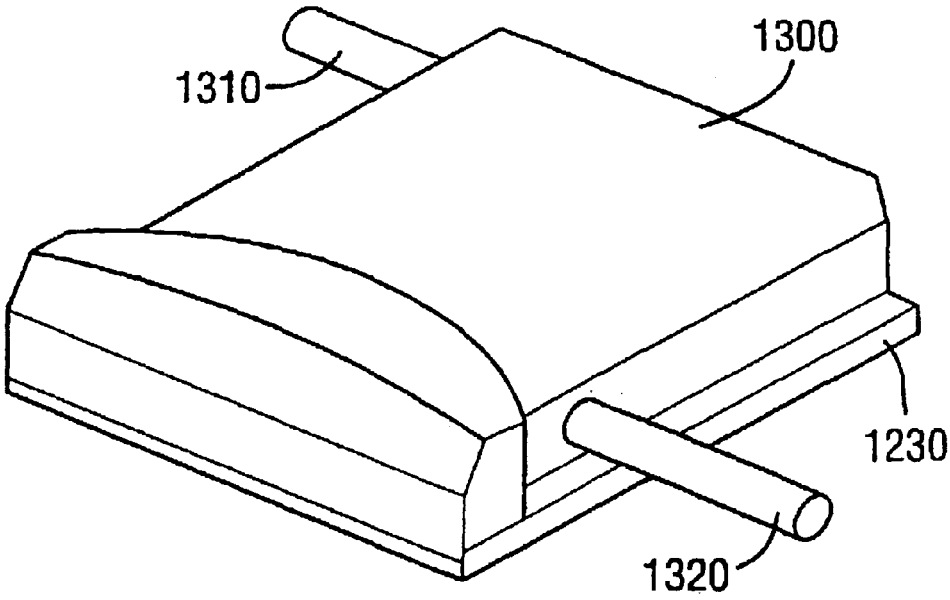
Figure 17:
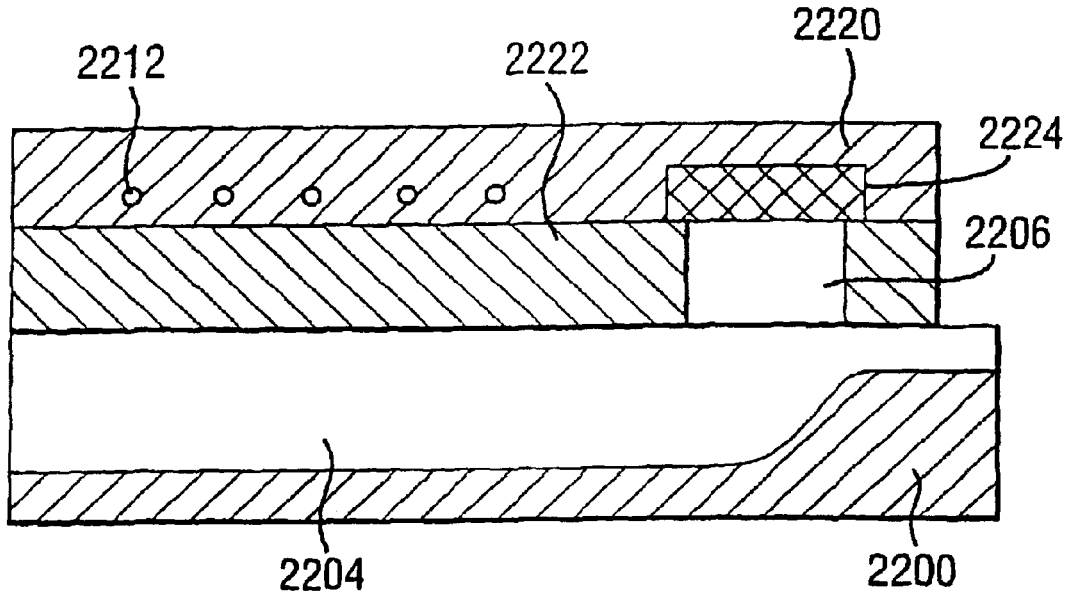
Figure 18:
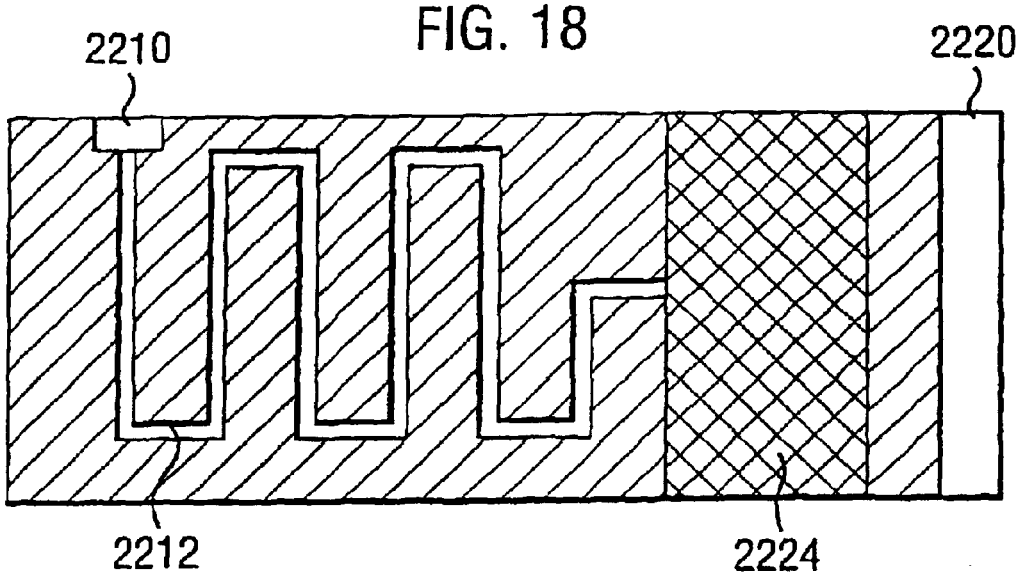
Figure 19:
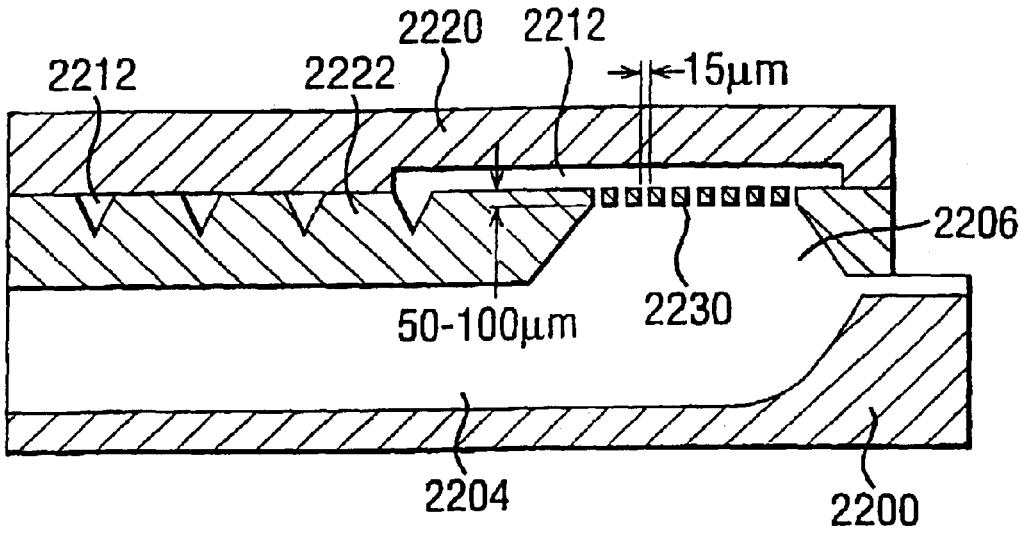
Figure 20:
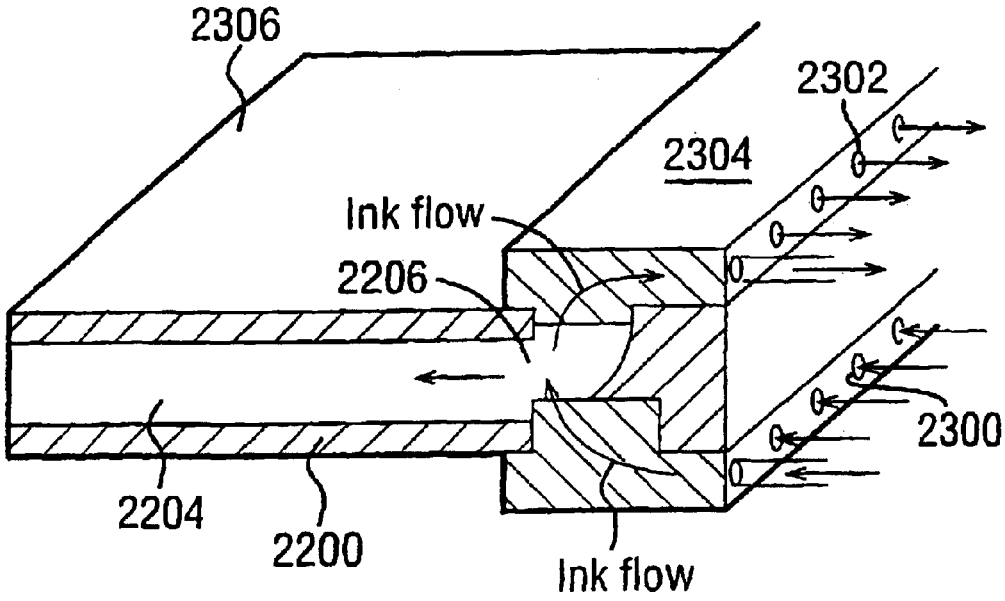
Figure 21A:
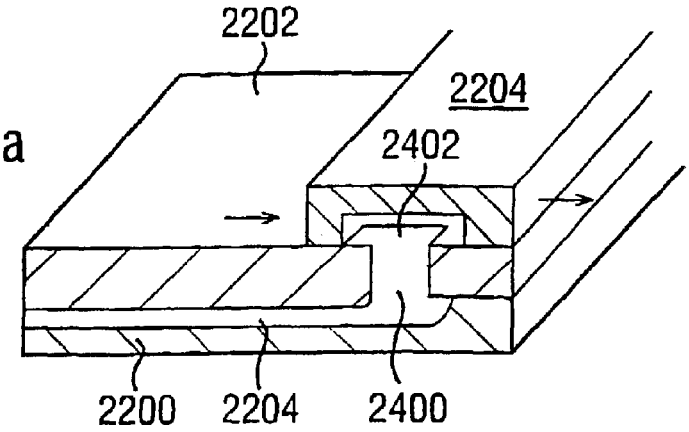
Figure 21B:
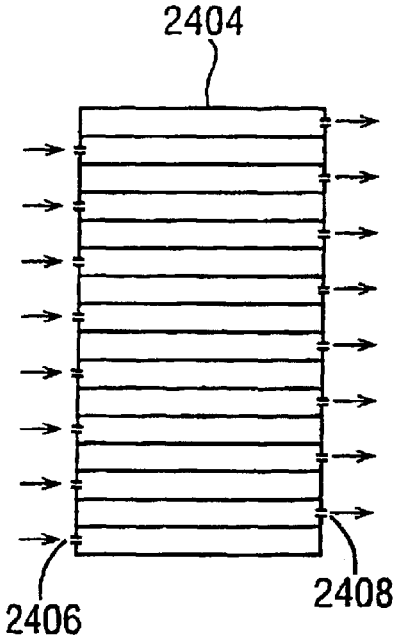

FIG. 9 is an exploded partly diagrammatic perspective view of an embodiment of a printhead having a base and a cover;

FIG. 10 is a front view of a printhead;

FIG. 11 is a graph illustrating the temperature gradient across the printhead of FIG. 10 during droplet ejection;

FIG. 12 is a perspective view of the printhead of FIG. 9 with a heat sink attached to the cover;

FIG. 13 is a partial perspective view of drive circuitry for supplying actuating electrical signals to the printhead of FIG. 12;

FIG. 14 is a perspective view of a casing for supplying coolant fluid to the printhead and heat sink of FIG. 13;

FIG. 15 is a side cross-sectional view of another printhead;

FIG. 16 is a top cross-sectional view of a fluid supply conduit of the printhead shown in FIG. 15;

FIG. 17 is a side cross-sectional view of another printhead;

FIG. 18 is a top cross-sectional view of an fluid supply conduit of the printhead shown in FIG. 17;

FIGS. 19 to 22 are cross-sectional views of further printheads, in which FIG. 21*b* illustrates stagger of the ink inlets and outlets of the printhead shown in FIG. 21*a*.

The present invention relates to droplet deposition apparatus, such as, for example, drop-on-demand ink jet printing apparatus. In the preferred embodiments, the droplet deposition apparatus comprises a printhead module for attachment to the carriage or body of a ink jet printer. Such embodiments will now be described with reference to FIGS. 1 to 5.

Figure 1:
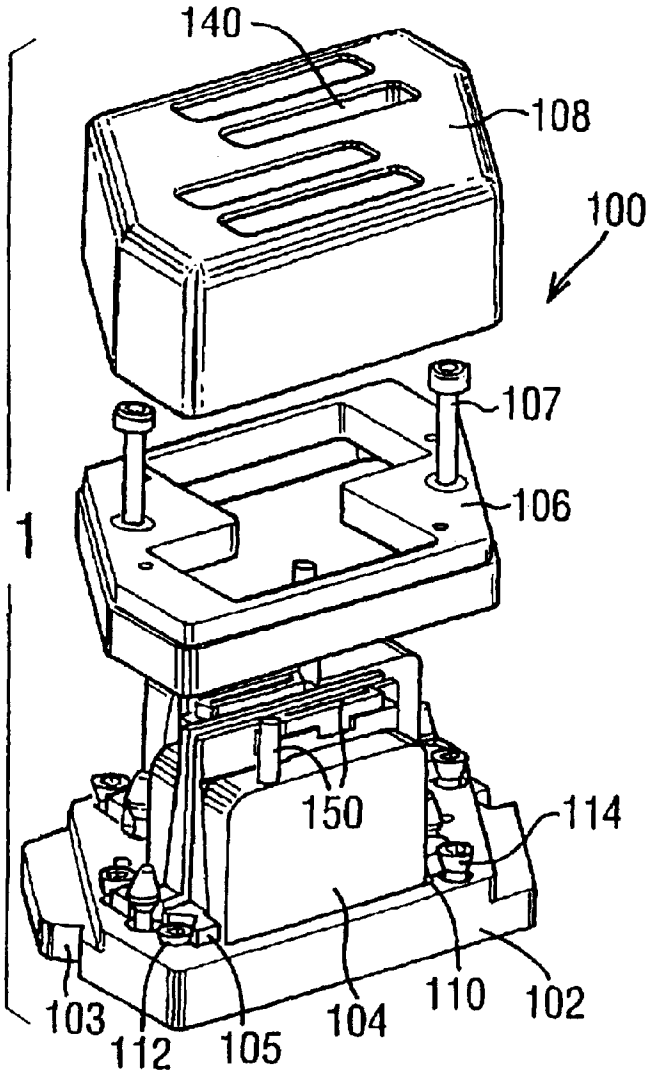
FIG. 1 represents an exploded view of a first embodiment of droplet deposition apparatus.

With reference to FIG. 1, the printhead module 100 comprises a base plate 102 on which one or more printheads 104 are adjustably mounted, a clamping device 106 and cover 108. In the embodiments shown in FIGS. 1 to 3, there are four printheads 104 adjustably mounted on the base plate 102. However, any number of printheads may be mounted on the base plate 102; in the embodiment shown in FIG. 4 two printheads may be mounted on the base plate 102. The printheads may be arranged in a staggered formation, as in the embodiments shown in FIGS. 2 and 4, or in pairs, as in the embodiment shown in FIG. 3. Two printheads in a pair may be mounted side-by-side in order to improve package density.

Figure 2:
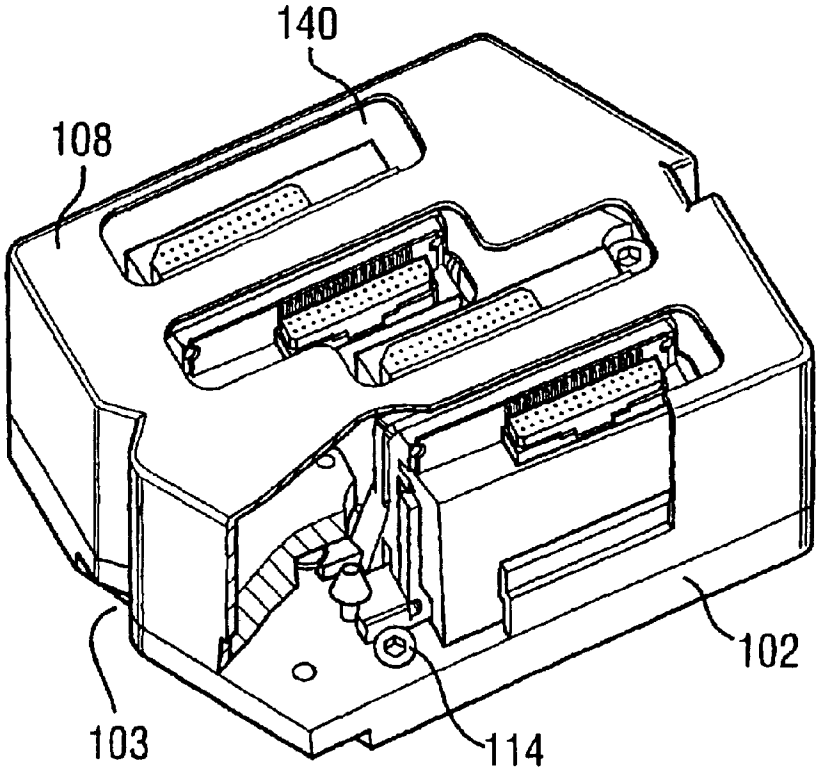
FIG. 2 represents a rear perspective view of the droplet deposition apparatus of FIG. 1 with cover and clamping device partly cut away.

The base plate 102 is mountable on the printer by any conventional means, such as bolts, clips or the like. Alignment of the base plate on the printer is performed using a datum 103 on the base plate. As shown in FIG. 2, the datum 103 is embodied in this embodiment by a groove 103 formed in the base plate 102, but the datum may take any convenient form.

Each printhead 104 comprises a plurality of nozzles from which ink is ejectable by the application of an electrical signal to actuation means associated with a fluid chamber communicating with that nozzle, as is known e.g. from EP-A-0 277 703, EP-A-0 278 590 and, more particularly, UK application numbers 9710530 and 9721555 incorporated herein by reference. The actuation means of each printhead 104 is connected to associated drive circuitry, with the fluid chambers being connectable to one or more ink reservoirs.

As shown more clearly in FIG. 4, each printhead comprises an external frame portion 105 to enable the printhead to be mounted on the base plate 102. The frame 105 may be integral with the printhead 104, or may be separate therefrom. For clarity purposes only, FIG. 4 illustrates only the frame 105 mounted on the base plate 102.

Figure 3:
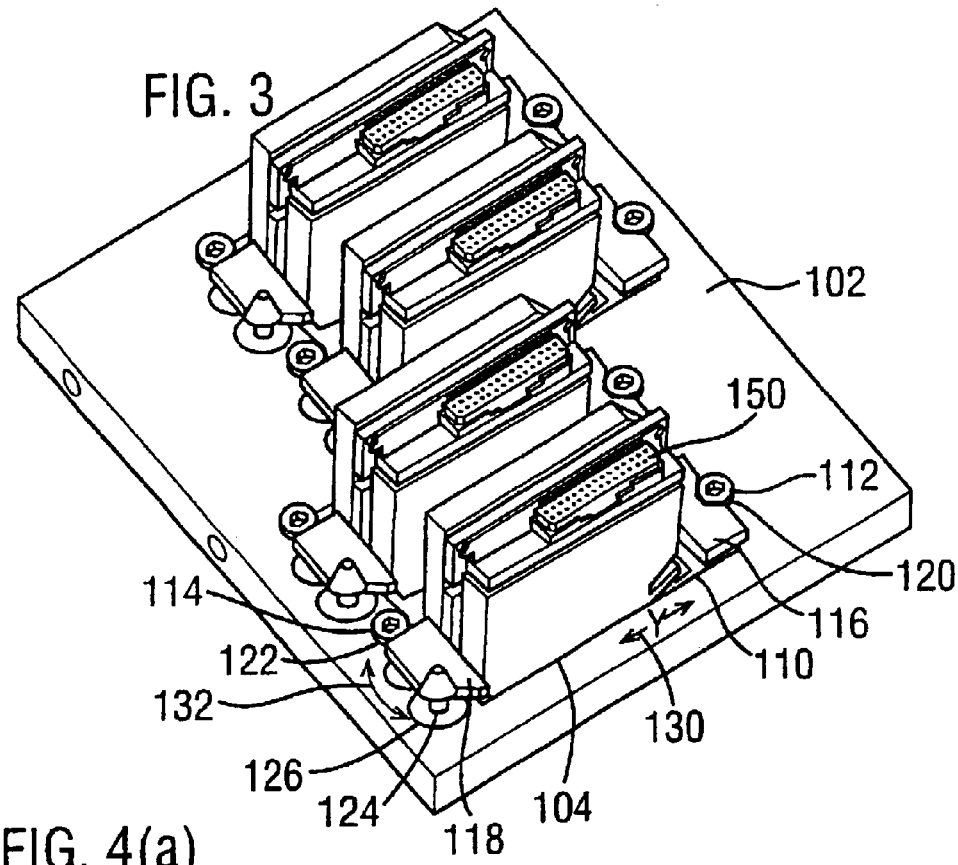
FIG. 3 represents a rear perspective view of a second embodiment of droplet deposition apparatus with cover and clamping device fully removed.

As shown in more detail in FIGS. 3 and 4, each printhead 104 is mounted in a slot 110 formed in the base plate 102 so that the nozzles of the printhead are exposed by the slot 110 to enable ink ejected from the nozzles to be deposited on a printing surface. Each printhead is adjustably mounted on the base plate 102 by means of tapered adjustment screws 112, 114, as shown in FIG. 5(*a*), which engage respective alignment surfaces 116, 118 of the printhead 104. Each adjustment screw 112, 114 has a screw thread which engages a threaded bore 120, 122 formed in the base plate 102. As illustrated in FIGS. 4 and 5(*b*), the alignment surfaces 116, 118 of the printhead 104 are also tapered, the taper preferably conforming to that of the adjustment screw.

Thrust pin 124 mounted in the base plate 102 serves to urge the alignment surfaces 116, 118 of the printhead against the adjustment screws 112, 114. With reference to FIG. 5(*c*), the thrust pin 124 projects from a casing 126 which is mounted in the base plate 126 and houses a spring or other resilient member which biasses the thrust pin 124 away from the casing 126. If pushed sideways, the thrust pin 124 can be tilted away from the alignment surface 118 to enable the frame 105 to be mounted in and removed from the slot 110.

To align each printhead 104 on the base plate 102, the printhead 104 is mounted in a slot 110 of the base plate 102 and held in position by the adjustment screws 112, 114 and thrust pin 124. The printhead is then connected to the printer to enable ink to be ejected from the printhead. A swath of print is then produced by the printhead. With reference to the position of the swath of print relative to the datum 103, the location of the printhead 104 on the base plate 102 is adjustable by means of adjustment screw 112. By turning the adjustment screw 112 in the bore 120, the engagement of the tapered alignment surface 116 of the printhead 102 with the screw 112 causes the printhead to move in the Y direction as indicated by arrow 130 in FIGS. 3 and 5(*b*). Similarly, the orientation of the printhead 104 relative to the base plate 102 is adjusted by means of adjustment screw 114. By turning the adjustment screw 114 in the bore 122, the engagement of the tapered alignment surface 118 of the printhead 102 with the screw 114 causes the printhead to rotate about adjustment screw 112, as indicated by arrow 132 in FIG. 3. Typical adjustment ranges of the adjustment screws 112, 114 are 0.8 mm (±0.4 mm) and 1° (±0.5°) respectively.

The position of the printhead on the base plate is adjusted using the adjustment screws 112, 114 until a swath of print produced by the printhead is in a predetermined position relative to datum 103 on the base plate 102. Each printhead is adjustable in turn so that the swaths of print produced by each printhead is in a predetermined position relative to datum 103. Thus, if the printer were to become defective, the base plate 102 can be removed from the defective printer and accurately mounted on the replacement printer using the datum 103 to locate accurately the base plate on the printer, that is, without having to re-align each individual printhead 104. This can provide for quick and simple replacement of the defective printer without loss of printhead alignment.

When the positions of all of the printheads 104 mounted on the base plate 102 have been suitably adjusted, the printheads are disconnected from the printer to enable a clamping device 106 to be mounted on the base plate 102 by means of bolts 107 to hold the printheads in their desired positions. The clamping device 106 also serves to shield the adjustment screws 112, 114 from accidental movement. Fixation screws (not shown) may be used to fix the printheads in their adjusted positions.

As shown in FIG. 2, cover 108 serves to protect physically the printheads 104 mounted on the base plate 102. Apertures 140 are formed in the cover 108 to expose connectors 150 formed on the end of the printhead 104 remote from the nozzles to enable the printheads to be separately electrically and fluidly reconnected to the printer.

The base plate 102 further comprises a slotted plate 160 which is mountable on the base plate 102. With reference to FIG. 6, there are a number of slots 162, typically 1–2 mm in width was shown in FIG. 7, formed in the slotted plate 160, one for each printhead 104 mountable on the base plate 102.

FIG. 7 is a cross-sectional view illustrating the alignment of a printhead 104 with the base plate 102 and slotted plate 160. As shown in FIG. 7, the slotted plate 160 is aligned with the base plate 102 so that nozzles 170 formed in nozzle plate 172 of the printhead 104 are exposed to enable ink ejected from the nozzles to pass through the slotted plate 160 without impinging on the sides of the slotted plate 160. The outer surface 164 of the slotted plate 160 may be coated in order to improve wear resistance.

The upper surface of the nozzle plate 172 and the walls of the slot 162 formed in the slotted plate together define a recess 180. During droplet ejection from the nozzles 170 formed in the nozzle plate 172, droplets of fluid which may become broken off from the body of the droplet during ejection of the droplet from the nozzles may be collected in the recess. This collection of fluid in the recess may lead to deflection of the droplet during ejection, and therefore inaccurate location of the ejected droplet on the printing surface, and eventually to blockage of the nozzles 170.

In order to avoid such problems, the apparatus includes means, such as a wiper blade 190, movable into the recess to remove any ink collected in the recess. As shown in FIG. 8, the slotted plate 160 serves to prevent the wiper blade from coming into contact with the nozzle plate, thereby preventing damage to the nozzle plate by the wiper blade, with ink being drawn into the material of the wiper blade under the action of surface tension.

FIG. 9 is an exploded perspective view of a part of a printhead 1100. The printhead comprises a base 1110 in the form of a sheet of piezoelectric material poled in a direction parallel to the Z-axis in FIG. 9. The direction of polarisation is illustrated by arrows 1120. The base is formed with a row of parallel fluid chambers or channels 1130. The channels 1130 are closed by a cover 1140 which extends over the entire top surface of the printhead. Fluid, such as ink, is supplied from an ink reservoir (not shown) to an ink inlet 1150 located on the cover 1140, which supplies ink to a conduit 1160 extending substantially the entire width of the cover in order to provide ink to each of the channels 1130.

The channels 1130 are of end-shooter configuration, terminating at corresponding ends thereof in a nozzle plate 1170 in which are formed nozzles 1175, one for each channel 1130. Ink is ejected on demand from the channels 1130 in the form of droplets and deposited on a print line of a print surface between which and the printhead 1100 there is relative motion normal to the plane of the channel axes.

The channels 1130 are long and narrow with a rectangular cross-section and have opposite side walls 1180 which extend the length of the channels. The side walls 1180 of the channels 1130 are provided with electrodes 1190 extending along the length of the channels. Actuating electrical signals applied to the electrodes 1190 produce shear mode actuation in the upper half of the walls 1180. The lower halves of the walls are forced to follow the motion of the upper halves, so the walls deform into chevron shapes. The deflection of the walls pressurises the ink in the channel, ejecting fluid from the nozzles 1175. Wire bond interconnects 1200 to the rear of the base supply the actuating electrical signals to the electrodes 1190 from drive circuitry (not shown).

Consider, by way of example, an arrangement as illustrated in FIG. 10, in which the fluid chambers are divided into groups A and B. A temperature sensor S1 is arranged to measure the temperature towards the centre of group A, and temperature sensor S2 is arranged to measure the temperature towards the centre of group B. FIG. 11 depicts the variation with time of the temperatures $T_1$ and $T_2$ detected by sensors S1 and S2 respectively when fluid chamber group A only is actuated to eject droplets from the nozzles thereof. As shown in FIG. 11, there is a clear temperature difference AT between the detected temperatures $T_1$ and $T_2$. Such a temperature difference between fluid chambers can lead to a difference in the amount of fluid ejected from the fluid chambers, resulting in variations in the size of printed dots. It is therefore desirable to reduce ΔT.

Such a reduction can be achieved by forming the cover 1140 from material with a relatively high thermal conductivity, but with a coefficient of thermal expansion, $C_{TE}$, substantially the same as that of the piezoelectric material, such as PZT, forming the sheet 1110. Suitable materials for the cover include silicon and aluminium nitride.

To assist heat dissipation and to distribute amongst the channels any heat generated during droplet ejection, as shown in FIG. 12 a heat sink 1200 is connected to the cover 1140. The heat sink is formed from aluminium, and comprises a number of fins 1210. In the embodiment shown in FIG. 12, the heat sink 1200 has four fins 1210, although a heat sink with any number of fins could be used. An ink inlet 1220 is formed in the heat sink for supplying ink to the inlet 1150 formed in the cover 1140.

FIG. 13 is a perspective view showing the drive circuitry for the printhead 1100. The printhead 1100 is mounted on a base plate 1230, to which is attached a low density circuit board 1240 on which the drive circuitry is mounted. The drive circuitry 1250 includes chips 1260 which, as shown in FIG. 13, can be encapsulated by encapsulant 1270, although this is not essential.

During the supply of actuating electrical signals from the drive circuitry 1250 to the printhead 1100, heat is generated in the drive circuitry 1250. With reference to FIG. 14, in order to promote cooling of both the drive circuitry 1250 and the heat sink 1200, a casing 1300 can be attached to the base plate 1230 to enclose the printhead 1100 and drive circuitry 1250, and a stream of coolant fluid, such as pressurized air, injected into the casing 1300 via inlet 1310. Outlet 1320 enables coolant fluid to pass out fro the casing 1300. The inlet and outlet typically have a dimension of 5 mm.

The inlet is arranged so that the stream of coolant fluid strikes the cooling fins of the heat sink. By use of valves provided at the inlet and outlet, the rate of flow of the coolant stream into the casing and the pressure of the coolant fluid inside the casing can be controlled. For example, with a flow rate of 40 liters/min at 1 bar overpressure, the sheet 110 and the chips 260 can be cooled to 57° C. and 33° C. respectively when running the printhead at 7.8W without any ink present in the channels.

In addition to supplying coolant fluid to the drive circuitry and the heat sink, the casing may be utilised to deposit a parylene passivant over the drive circuitry. Vapour phase parylene is injected into the inlet 1310, which condenses to form a water resistant monolayer to protect the drive circuitry from any water vapour contained in the coolant fluid subsequently injected into the casing. This avoids the need to encapsulate the chips of the drive circuitry, which encapsulant tends to act as a thermal insulator, and thus allows for a greater reduction in the temperature of the chips.

FIG. 15 illustrates a side cross-sectional view of a printhead 2104. As known, for example, from EP 0,277,703 the printhead comprises a sheet 2200 of poled piezoelectric material, such as lead zirconium titanate (PZT) in which a plurality of substantially parallel-sided channels are formed. A cover plate 2202 is mounted on the upper surface of the sheet 2200 substantially to close the channels to define fluid chambers 2204. A fluid supply manifold 2206 is formed in the cover plate 2202 for supplying fluid to one or more of the fluid chambers 2204. Where the printhead is arranged to deposit ink of a single colour, the manifold 2206 may supply fluid to all of the fluid chambers of that printhead. Otherwise, there may be a plurality of manifolds, each supplying ink of a respective colour to a respective number of fluid chambers. A filter 2208 is disposed between manifold 2206 and ink inlet 2210, in fluid communication with an ink reservoir (not shown), in order to protect the fluid chamber from contamination by the ingress of dirt.

A conduit 2212 is disposed in the printhead for conveying fluid from the ink inlet to the filter 2208. In order to prevent air bubbles trapped in the fluid from flowing through the filter 2208 into the manifold 2206, and from there into the fluid chambers 2204, the conduit is arranged to lead air bubbles in the droplet fluid to an air outlet 2214 of the printhead. The air outlet 2214 may be in the form of an air bleed, or alternatively in the form of an ink outlet to enable droplet fluid to be returned to the ink reservoir.

As shown in FIG. 16, in this embodiment the conduit 2212 has a serpentine arrangement, which causes air bubbles in the fluid being supplied to the manifold 2206 to flow in the direction of extension of the conduit, that is, tortuously towards the air outlet 2214, without becoming blocked in the conduit. The conduit may take any other tortuous arrangement, such as, for example, a spiral arrangement.

FIG. 17 illustrates a side cross-sectional view of another embodiment of a printhead 2104. This embodiment is similar to that shown in FIG. 15, with the exception that the cover plate comprises two adjacent plate members 2220, 2222 bonded to the PZT sheet 2200.

A serpentine conduit 2212 and filter housing 2224 are formed in the first plate member 2220. As shown in FIG. 18, the conduit conveys droplet fluid from the ink inlet 2210 to the filter housing 2224. The filter housing 2224 is in fluid communication with a manifold 2206 formed in the second plate member 2222, the manifold 2206 being in turn in fluid communication with a plurality of fluid chambers 2204 formed in the PZT sheet 2200.

In this embodiment, the first and second plate members 2220, 2222 are also formed from PZT material to ensure that the cover plate has good thermal expansion compatibility with the PZT sheet 2200, as well as suitable stiffness. However, PZT is a relatively poor conductor of heat, which can give rise to a poor temperature gradient across the head. An embodiment of a printhead in which the cover is formed from one of silicon and aluminium nitride is shown in FIG. 19. In this embodiment, a serpentine conduit 2212 is formed on the facing surfaces of the cover members 2220, 2222, for example, by etching. Such an etching technique may be used to form concomitantly a filter 2230 in the second plate member 2222. Etching can enable the filter to be formed both easily and accurately with relatively small dimensions, for example, of thickness between 50 and 100 microns with apertures of width approximately 15 microns.

Forming the cover from one of silicon and aluminium nitride can enable the cover to act as a heat sink for dissipating heat generated during actuation. To assist heat dissipation, a heat sink may be connected to the cover. The flow of ink through the conduit 2212 formed in the cover also acts to distribute heat generated during actuation of the fluid chambers to ensure a uniform temperature of the printhead.

Figure 22:
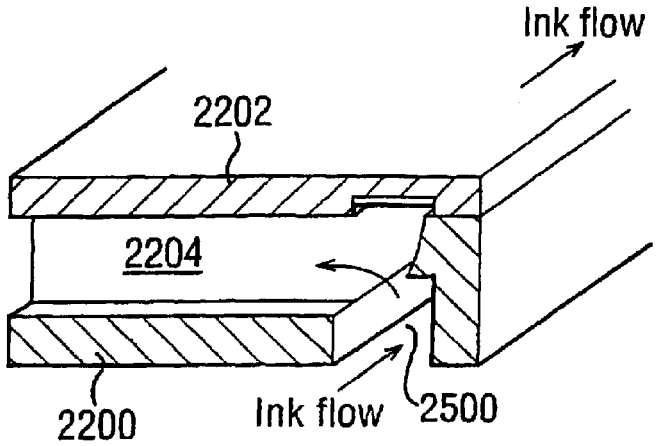

In the above described embodiments, the conduit is formed in a substantially planar cover bonded to the PZT sheet, and supplies fluid to a common manifold via a filter. FIGS. 20 to 22 illustrate alternative arrangements for conveying droplet fluid directly towards and away from a common manifold whilst leading air bubbles in the droplet fluid towards an ink outlet.

In the embodiment shown in FIG. 20, a plurality of ink inlets 2300 and ink outlets 2302 are formed in a manifold member 2304 attached to the end of the PZT sheet 2200 remote from the nozzles. The tops of the channels formed in the PZT sheet are closed by a cover plate 2306 bonded to the PZT sheet. Fluid is conveyed from the ink inlets 2300 into a manifold 2206 formed in the manifold member 2304, and from the manifold 2206 to the fluid chambers 2204. Fluid is returned to an ink reservoir (not shown by ink outlets 2302. Consequently, fluid flows in a tortuous manner from an inlet to an outlet. In this embodiment, air bubbles in the fluid being supplied to the manifold 2206 rise from the inlets 2300 directly to the outlets 2302 without entering the fluid chambers.

In the embodiment shown in FIGS. 21*a* and 21*b*, apertures 2400 are formed in the cover plate 2202 to supply droplet fluid to the fluid chambers 2204. Ink is supplied to the apertures from a manifold 2402 formed in a manifold member 2404 attached to the cover plate 2202. Similar to the fourth embodiment described above, the manifold member 2404 includes a plurality of ink inlets 2406 and a plurality of ink outlets 2408. As shown in FIG. 21*b*, the ink outlets are staggered with respect to the ink inlets, with the result that fluid is conveyed in a tortuous manner from a ink inlet to a ink outlet via the manifold 2402 with air bubbles passing directly from an inlet to an outlet.

In the embodiment illustrated in FIG. 22, a conduit 2500 for conveying fluid towards and away from the fluid chambers 2204 is formed in the PZT sheet 2200 and cover plate 2202 substantially perpendicular to the channels formed in the PZT sheet. Air bubbles trapped in the conduit flow from the inlet of the conduit to the outlet without entering the fluid chambers 2204.

Each feature disclosed in this specification (which term includes the claims) and/or shown in the drawings may be incorporated in the invention independently of other disclosed and/or illustrated features.

What is claimed is:

1. Droplet deposition apparatus comprising a base and at least one printhead adjustably mounted on the base and positionable relative to a datum on the base such that a swath of print produced by the printhead is in a predetermined position and orientation relative to the datum, the base being locatable on a printer using the datum.

2. Apparatus according to claim 1, comprising a plurality of said printheads, each printhead being adjustably mounted on said base and positionable relative to said datum on the base such that swathes of print produced by the printheads are in respective predetermined positions relative to the datum.

3. Apparatus according to claim 2, wherein said printheads are arranged in pairs on the base.

4. Apparatus according to claim 1, comprising means for adjusting the position of the or each printhead on the base relative to the datum.

5. Apparatus according to claim 4, wherein said adjusting means comprises means for adjusting the location of the or each printhead relative to the datum and means for adjusting the orientation of the or each printhead relative to the datum.

6. Apparatus according to claim 4, wherein said adjusting means comprises a plurality of adjustment members engaging the or each printhead, each adjustment member being movable relative to the base so as to adjust the position of the printhead on the base.

7. Apparatus according to claim 6, wherein each adjustment member comprises a tapered surface, the printhead being urged against the tapered surface so that movement of the tapered surface relative to the base adjusts the position of the printhead on the base.

8. Apparatus according to claim 7, wherein the printhead includes a tapered surface engaging a conformingly tapered surface of an adjustment member.

9. Apparatus according to claim 4, comprising means, resiliently mounted on the base, for urging a printhead against the adjustment means.

10. Apparatus according to claim 4, comprising means, mountable on the base, for shielding said adjustment means in order to prevent accidental adjustment of the position of the or each printhead on the base.

11. Apparatus according to claim 1, comprising a slotted member, mountable on the base, having at least one slot formed therein so that fluid ejected from the or each printhead passes through a respective slot.

12. Apparatus according to claim 11, wherein each printhead comprises a plurality of nozzles formed in a nozzle plate, said nozzle plate and the walls of the slot through which ink ejected from the nozzles passes defining at least part of a recess into which ink removal means is movable to remove any ink collected in the recess following ejection from one of the nozzles.

13. Ink jet printer apparatus comprising a base and at least one print head adjustably mounted on the base and positionable relative to a datum on the base wherein a plurality of adjustment members engaging the print head are provided for adjusting the position of the print head, wherein a swath of print produced by the print head is in a predetermined position relative to the datum, the base being located on a printer using the datum, and wherein each adjustment member is movable relative to the base so as to adjust the position and orientation of a surface angled with respect to the base and wherein movement of the angled surface relative to the base adjusts the position of the printhead on the base.

14. Apparatus according to claim 13, wherein said angled surface is a tapered surface on an adjustment member.

15. Apparatus according to claim 14, wherein the print head includes a tapered surface engaging a conformingly tapered surface of an adjustment member.

16. Apparatus according to claim 13, comprising means resiliently mounted on the base for urging a print head against the adjustment member.

17. Apparatus according to claim 13, comprising means, mountable on the base, for shielding said adjustment member in order to prevent accidental adjustment of the position of the print head on the base.

18. Apparatus according to claim 13, comprising a slotted member, mounted on the base, having at least one slot formed therein so that fluid ejected form the or each print head passes through a respective slot.

19. Apparatus according to claim 18, wherein each print head comprises a plurality of nozzles formed in a nozzle plate, said nozzle plate and the walls of the slot through which ink is ejected form the nozzles passes defining at least part of a recess into which ink removal means is movable to remove any ink collected in the recess following ejection form one of the nozzles.

20. Method for aligning a print swath relative to an inkjet printer that comprises a base and a print head adjustably mounted on the base, comprising the steps of positioning a print head on a base in a position relative to a datum on the base such that swath of print produced by the print head is in a predetermined position and orientation relative to the datum, and locating the base on an inkjet printer using the datum.

21. A method according to claim 20, comprising adjustably mounting more than one print head on the base.

22. A method according to claim 20, comprising arranging said print heads in pairs on the base.

23. A method according to claim 20, comprising adjusting at least one of the position and orientation of the print head relative to the datum by at least one adjustment member engaging the print head.

24. A method according to claim 23, wherein a plurality of said adjustment members engaging the print head.

25. A method according to claim 24, comprising moving said adjusting member relative to the base so as to adjust the position and/or orientation of the print head on the base.

26. A method according to claim 24, wherein said printer further comprises means, resiliently mounted on the base, for urging a print head against the adjustment member.

* * * * *

UNITED STATES PATENT AND TRADEMARK OFFICE

CERTIFICATE OF CORRECTION

PATENT NO. : 6,796,630 B2
DATED : September 28, 2004
INVENTOR(S) : Ison et al.

It is certified that error appears in the above-identified patent and that said Letters Patent is hereby corrected as shown below:

Title page,
Item [30], Foreign Application Priority Data, delete "0003760" and insert -- 0003760.6 --.

Column 12,
Lines 55, 60 and 63, delete "form" and insert -- from --.

Column 13,
Line 1, delete "swath" and insert -- a swath --.

Signed and Sealed this

Fifth Day of April 2005

JON W. DUDAS
*Director of the United States Patent and Trademark Office*